US005983983A

United States Patent [19]

Whateley

[11] Patent Number: 5,983,983

[45] Date of Patent: Nov. 16, 1999

[54] METHOD OF MAKING FINE GRAINED CASTINGS

[75] Inventor: Philip Neil Whateley, Exmouth, United Kingdom

[73] Assignee: Triplex Llyod Limited, West Midlands, United Kingdom

[21] Appl. No.: 08/920,522

[22] Filed: Aug. 29, 1997

[30] Foreign Application Priority Data

Aug. 30, 1996 [GB] United Kingdom ..... 9618216

[51] Int. Cl.[6] ..... B22D 27/04; B22D 27/20

[52] U.S. Cl. ..... 164/517; 164/157.1; 164/523

[58] Field of Search ..... 164/14, 55.1, 57.1, 164/58.1, 517, 523

[56] References Cited

U.S. PATENT DOCUMENTS

| | | | |
|---|---|---|---|
| 3,019,497 | 2/1962 | Horton et al. | 164/523 X |
| 3,157,926 | 11/1964 | Horton et al. | 164/523 X |
| 3,158,912 | 12/1964 | Schweikert | 164/517 |
| 3,259,948 | 7/1966 | Feagin . | |
| 3,415,307 | 12/1968 | Schuh et al. . | |
| 3,450,189 | 6/1969 | MacDonald | 164/58.1 X |
| 4,550,761 | 11/1985 | Moore . | |
| 5,249,619 | 10/1993 | Meacock, II et al. . | |
| 5,314,000 | 5/1994 | Wang et al. . | |

FOREIGN PATENT DOCUMENTS

| | | | |
|---|---|---|---|
| 0198290 | 10/1986 | European Pat. Off. . | |
| 0 218 536 | 4/1987 | European Pat. Off. . | |
| 3821204 | 12/1989 | Germany . | |
| 984494 | 2/1965 | United Kingdom . | |
| 1011174 | 11/1965 | United Kingdom | 164/14 |
| 2074194 | 10/1981 | United Kingdom . | |
| WO 80/02811 | 12/1980 | WIPO . | |

OTHER PUBLICATIONS

"Investment–cast superalloys challenge wrought materials" from Advanced Materials and Process, No. 4, 1990, pp. 107–108.

"Solidification Processing", McGraw–Hill 1974, editors B.J. Clark and M. Gardner, pp. 154–157 and 172–174.

"Phase Transformations in Metals and Alloys", Van Nostrand Reinhold, 1981, D.A. Porter, p. 234.

Nazmy et al., The effect of advanced fine grain casting technology on the static and cyclic properties of IN713LC. Conf: High temperature materials for power engineering 1990 Kluwer Adademic Publishers 1990 pp. 1397–1404.

Bouse & Behrendt. Mechanical properties of Microcast–X alloy 718 fine grain investment castings. Conf: Superalloy 718: Metallurgy and applications 1989. Publ:TMS pp. 319–328.

Abstract of U.S.S.R. Inventor's Certificate 1306641 Published Apr. 30, 1987.

WPI Accession No. 85–090592/85 & Abstract of JP 60–40644 (KAWASAKI) Published Mar. 4, 1985.

WPI Accession No. 81–06485D/81 & Abstract of JP 55–149747 (SOGO) Published Nov. 21, 1980.

Fang, J: Yu, B Conference: High Temperature Alloys for Gas Turbines, 1982, Liege, Belgium, Oct. 4–6, 1982, Publ: D. Reidel Publishing Co., P.O. Box 17, 3300 AA Dordrecht, The Netherlands 1982 pp. 987–997.

*Primary Examiner*—J. Reed Batten, Jr.

*Attorney, Agent, or Firm*—Marshall, O'Toole, Gerstein, Murray & Borun

[57] ABSTRACT

A mould is provided having a surface which defines a mould cavity, and the mould surface includes on at a least part thereof a compound comprising a nucleation agent. The mould is heated. A metal heated to a temperature 0–15° C. above the liquidus temperature is poured into the heated mould cavity and the molten metal is solidified in the mould cavity.

17 Claims, No Drawings

METHOD OF MAKING FINE GRAINED CASTINGS

DESCRIPTION OF INVENTION

This invention relates to a method of making fine grained castings from molten metal.

Components for use in a hot gas environment of early gas turbine engines were produced by mechanical working at high temperature. Initially these components were produced by forging of austenitic stainless steels.

The development of austenitic steels led to the family of nickel base superalloys which, together with cobalt base superalloys, account for the majority of hot gas turbine components today.

Developments in the design and operating characteristics of both aerospace and industrial gas turbines have mandated a continuous improvement in design, processes and materials for components. These improvements have led to materials and designs for which the forging process is either uneconomic or technically impractical. For example, the high temperature requirements in the turbine stages closest to the burners has led to complex-cored single crystal components now being specified in advanced industrial gas turbines for the so-called stages 1 and 2. Cored parts are also now being specified for the later stages of turbines, both for cooling air and for weight reduction. Process economics and difficulties of forging the strongest alloys are also producing a trend towards cast components.

Medical implants are also being sourced more often as castings, primarily due to the costs of manufacture of the complex shapes required, by other methods.

The use of cast components for these applications has, however, been limited due to inhomogeneity of the cast micro structure and the generally coarser grain compared with forgings. The grain structure is believed to place a limit on the mechanical properties of cast components especially with regard to tensile strength, ductility and fatigue resistance.

It is therefore desirable that castings are produced having a grain morphology comparable to that of forged components.

Various procedures have been proposed for obtaining very fine grain structures (Nazmy et al. The effect of advanced fine grain casting technology on the static and cyclic properties of IN713LC. Conf: High temperature materials for power engineering 1990 Kluwer Academic Publishers 1990 pp 1397–1404). (Bouse & Behrendt. Mechanical properties of Microcast—X alloy 718 fine grain investment castings. Conf: Superalloy 718: Metallurgy and applications 1989. Publ: TMS pp 319–328.) Many of these processes have involved procedures such as inoculation of the melt with various additions, or mechanical stirring or agitation to fragment the emerging dendrite structure. Whilst these methods have produced fine grain structures the processes involved have compromised the ultimate target—enhanced mechanical properties.

For investment cast superalloys the use of a nucleation agent such as cobalt aluminate ($CoAl_2O_4$) addition to the primary coat of the shell mould has long been known to produce finer surface grain. (GB-A-984,494 and Investigation of the Surface Grain Refinement for Superalloys Castings. J Fang and B Yu Conference: High Temperature Alloys for Gas Turbines 1982, Liege, Belgium, Oct. 4–6, 1982. Publ: D. Reidel Publishing Co., P.O. Box 17, 3300 AA Dordrecht, The Netherlands 1982 p.p. 987–997). Unfortunately the effect is restricted to the surface and can promote the formation of deleterious fine columnar grains normal to the casting surface. The technique is still used for conventional grain casting but does not alone produce grain sizes comparable to forgings.

A further method (EP-A-0218536) is based on control of mould and metal temperature. The mechanism for this method is stated to be based on pouring metal at a very low superheat in such a way that the heat is rapidly extracted from the falling metal droplets which then solidify almost instantaneously. There are three key areas of difficulty with this method which EP-A-0218536 reveals:

(a) Care must be used to prevent the formation of columnar surface grain which the EP-A-0218536 states is often a consequence of using surface inoculants such as $CoAl_2O_4$.

(b) Care must be taken to prevent grain growth after solidification.

(c) Care must be taken to control the distribution of porosity so that hot isostatic pressing can be used to eliminate it from the finished component.

The following techniques are disclosed in EP-A-0218536 to overcome these problems.

(a) The liquidus temperature of the alloy charge is measured for each melt. Heat is then extracted from the melt to bring it to within 20° F. of the predetermined liquidus temperature.

(b) The metal is poured into a mould which is preheated to a temperature such that there is no thermal gradient between the mould and the metal.

(c) Heat is rapidly extracted from the mould after casting in such a way as to prevent growth of the solidified grains.

There are significant disadvantages in using this process under production conditions. The first problem is the use of a mould heated to prevent thermal gradient between mould and metal. Even for nickel-base superalloys, the liquidus temperature is somewhat above 1300° C. (alloy IN 738LC has a liquidus of 1330° C.), with cobalt base alloys somewhat higher and steels higher still. This has severe consequences for mould strength since standard investment casting shell moulds normally rely on a silica bond to retain high temperature strength. For conventional investment casting, mould temperatures in the range 900° C. to 1100° C. are typical.

Equipment is needed to heat moulds to these temperatures and difficulties arise due to the handling of very hot moulds before and after casting.

The use of such hot moulds creates a further problem, namely the need to extract heat rapidly after casting to prevent grain growth. This too requires special techniques and equipment to achieve.

In addition to the processing problems and the costs involved there are significant problems in terms of quality. The techniques make it very difficult to contain microporosity within the component—a requirement for HIP processing to be used successfully. This is especially true when casting cored components. At the same time the fact that both mould and metal pouring temperature are determined by the alloy liquidus severely limits the options for designing a robust process.

Accordingly, an object of the present invention is to provide a method of making fine grained castings from molten metal in which the above mentioned problems are overcome or reduced and in particular a method which is less complicated and easier to control.

According to the present invention I provide a method of making a fine grained casting from molten metal comprising the step of providing a mould having a surface which defines a mould cavity, said surface having on at least part thereof a compound comprising a nucleation agent, melting the metal, heating the mould, casting the molten metal into the heated mould cavity and solidifying the molten metal in the mould cavity.

The nucleation agent may comprise cobalt aluminate or cobalt oxide.

Cobalt aluminate and cobalt oxide are typical nucleating agents for nickel and cobalt base alloys, but are not exclusive.

The amount of nucleation agent may be varied to change nucleation and hence grain growth.

The molten metal may be poured into the mould at a predetermined pouring temperature and the mould may be heated so as to be at a predetermined temperature when the metal is poured into the mould.

There may be a predetermined relationship between the mould temperature and the metal pouring temperature.

A relationship between mould and metal pouring temperature is established by the requirements of an individual job. The metal pouring temperature will effectively be defined by the liquidus of the alloy (although not on a melt-by-melt basis as per EP-A-0218536.) The mould temperature is determined during the development phase, for a particular casting, in order to give the required grain structure and integrity, and is then fixed for that casting.

The predetermined pouring temperature may lie in the range 0° C. to 15° C. above the liquidus temperature. The predetermined mould temperature may lie in the range 750° C. to 1250° C.

The predetermined pouring and mould temperatures may be fixed for making at least one further casting in a further mould.

Said predetermined pouring temperature may be predetermined in accordance with the article to be cast without performing a step of determining melting temperature of the actual metal to be poured.

The mould may be pre-heated either in a pre-heating oven or by using a mould heater within a casting unit.

The metal charge may be heated in air, under vacuum or under an inert atmosphere according to the alloy and product to be produced.

The nucleation agent may comprise up to 50% of the filler of the primary slurry coat, typically up to 25%. The minimum amount of nucleation agent is typically 1% but lower amounts may be found to be effective. In general the minimum necessary nucleation agent is used to obtain a desired product for a particular part.

The molten metal may be solidified in the mould by permitting cooling of the mould to take place under ambient foundry conditions.

Ambient foundry conditions may comprise substantially still air at temperatures normally found in a foundry and are a function of weather conditions and location in the foundry related to furnaces and other equipment.

A pattern may be produced from an expendable material such as wax or a plastics material.

The pattern may contain at least one ceramic core.

Said at least one ceramic core may have a nucleation agent such as cobalt aluminate either included in the core mix or added to the surface of the mould and/or core.

At least one pattern may be assembled onto a support to form an investment casting or other mould.

The pattern may be invested to form a shell or other mould having a mould cavity defined by said pattern.

The ceramic mould may be fired to develop mechanical strength.

The resultant mould may be prepared and cleaned in conventional manner for a casting process.

After pouring the metal into the mould cavity, and allowing the mould to cool, the material of the mould may be removed from the metal casting when the mould is sufficiently cool to handle.

The casting may be hot isostatic pressed (HIP).

The theory of production of extremely fine equiaxed castings has been known for many years. The mechanism is essentially the same as that which produces an equiaxed grain zone in conventional castings. Dendrites form due to the initial chill and undergo remelting due to recalescence and fluid flow. Dendrite fragments are swept into the remaining liquid to act as homogenous nuclei, in conventional castings the equiaxed zone is coarse because the rate of nucleation is low compared with the rate of grain growth. However Flemings (Solidification Processing. Publ: New York, McGraw-Hill 1974 p 172) and Porter & Easterling (Phase transformations in metals and alloys. Pub: New York, Van Nostrand Reinhold 1981 p 234) describe how, at low metal temperatures, an extremely fine grain structure can develop resulting from catastrophic disintegration of the prior dendrite population.

The successful application of this technology requires that the disintegration of the dendrite structure occurs at a point when the remaining liquid is cooled sufficiently to prevent remelting of the dendrite fragments or to prevent significant grain growth after solidification. On the other hand the remaining liquid must not be over cooled as normal nucleation will occur from the melt resulting in coarse grains.

The mechanism of solidification also severely limits feeding of shrinkage. The resultant microporosity may require HIP processing of components. However, the commercially available HIP process is only successful if the porosity is enclosed within the casting. Surface connected porosity cannot easily be removed by HIP processing.

These problems have largely prevented the development of industrial processes based on this technology. It should be noted that the process of EP-A-0218536 is stated to rely on pouring at a low temperature such that all the superheat is removed as the metal droplets fall into the mould almost instantaneously ie. on impact, to give a cellular non-dendritic structure. This mechanism of solidification is not the same as in the instant application, namely the nucleation of an ultra fine grain by dendrite fragmentation caused by recalescence and remelting.

The basis of the invention as disclosed herein is that the combination of the simplified control of metal temperature and the use of a nucleation coat leads to considerably more process latitude being available compared to prior methods.

Specifically, the nucleation agent controls the initial grain formation and release of latent heat (recalescence) so that a mould temperature significantly lower than the poured metal temperature can be used. This has been found to avoid the need for artificial cooling of the mould after casting which would be required to prevent grain growth.

The initial solidification produced by the nucleating agent also ensures that porosity is enclosed within the casting produced.

A further advantage of the use of a nucleation agent is that the process is not so sensitive to temperature and hence is more robust than in hitherto known processes. In addition mould temperature and the proportion of nucleation agent in the coat can be used as factors to control the process.

In contrast, the process of EP-A-0218536 requires both metal and mould temperature to be fixed by the actual liquidus, the only control factors available are mould design and construction together with the rate of heat removal after casting.

An embodiment of the invention will now be described by way of example.

In this embodiment a pattern was made from wax in conventional manner but the pattern could be made from plastic or other expendable material in any known suitable way.

In the present example the pattern contained a ceramic core but if desired, the pattern may contain more than one ceramic core or may not contain any core. Although ceramic material has been described as suitable core material, if desired any other suitable material may be used.

The pattern may have a surface coating in which is incorporated a proportion of a desired nucleation agent. For example, the pattern may be provided with a ceramic slurry coating containing a proportion of a nucleation agent. Alternatively a suitable nucleation agent may be applied to the surface of the pattern prior to assembly.

Where a ceramic core is provided the ceramic core may, if desired, be provided with a nucleation agent. Where a nucleation agent is used this may be applied to the surface of the core after manufacture or included in the mix of the ceramic used to make the core.

If desired a mould may be produced where only the core contains nucleation agent but this is not usual.

Generally the pattern or a plurality of patterns are assembled onto a tree or other construction. The pattern is then invested in conventional manner with ceramic material to form a shell or other mould. Thus the wax pattern assembly is dipped into a primary slurry coat comprising a liquid binder and a particulate refractory filler which comprises a percentage addition of cobalt aluminate or other nucleation agent.

Whilst still wet, the primary coat is "dusted" with a stucco.

Subsequent coats are added using normal refractory slurry (without nucleation agent), each time using coarser grades of stucco to build up the required thickness of ceramic shell around the wax.

The mould thus defines a mould cavity and the surface, or at least a part of the surface, of the mould cavity is coated with a nucleation agent. If desired however, the ceramic core, when provided may provide the nucleation agent and in this case it is the surface of the mould cavity provided with the core or cores which provide the nucleation agent.

The wax or other expendable pattern material, together with the tree material is then removed in conventional manner for example by melting out of the wax using a steam autoclave or in any other suitable manner.

The thus de-waxed mould may then optionally be fired to burn off residual wax and fully develop the strength of the ceramic.

Thereafter the moulds are prepared and cleaned for casting, for example any necessary repair is carried out and, for example, they are wrapped and placed in casting tins and the like.

The mould is then pre-heated at a predetermined temperature for a predetermined time in any desired manner, for example in a pre-heating oven or by using a mould heater within a casting unit.

The temperature to which the mould is pre-heated is a temperature which is a predetermined temperature which is fixed for the component to be cast and determined during the development phase of the component casting process. So long as the component to be cast is the same the mould is pre-heated to said predetermined temperature.

The metal to be cast is then melted in a vacuum induction melting unit and the temperature of the metal is raised to the temperature at which it is to be poured. The pouring temperature is a predetermined value which is fixed for the composition of the metal to be cast. So long as the metal to be cast is of the same or substantially the same composition, the above mentioned predetermined temperature is not changed.

If desired, the metal may be melted and heated to the required temperature and/ or poured in air, or under an inert atmosphere according to the alloy composition and the product to be produced.

The heating of the metal to pouring temperature represents a relatively small heat above melting temperature of the metal, ie. above the metal liquidus temperature. In the present example the relatively small super heat may lie in the range 0° C. to 15° C.

The relationship between the mould and metal temperatures is a function of the metal temperature, which is fixed being a function of the liquidus, and the mould temperature which is determined during the development phase for each product to give the required characteristics of the castings. The fact that the mould temperature is below the metal temperature and may be varied during process optimisation is a benefit of the current process.

The metal is then poured at the above mentioned pouring temperature into the thus heated mould cavity.

Thereafter the mould is allowed to cool under ambient foundry conditions. That is to say, no special steps to cool the mould, such as forced air cooling or the like, are required. The mould is simply moved, as necessary, to a suitable position in the foundry and the normal foundry atmosphere allowed to surround the mould at ambient temperature. Of course, there may be some movement of air through the foundry as a result of convection or fans but these air movements, if any, are provided for extraneous reasons and the regime of cooling of the mould or cavity is of no particular consequence for this invention.

If desired, the mould could be subjected to a cooling regime which achieves a greater cooling rate than exposure to ambient foundry atmosphere or indeed at a slower rate but it has been found that the method of the present intention is relatively insensitive to such adjustments of cooling rate and more particularly that no special steps to control cooling are required.

The mould material is removed from the metal of the casting when the mould is sufficiently cool to handle and the castings are cut from the mould tree in order to maximise the innate left on the casting. This improves any subsequent HIP processing operation.

Thereafter the method is performed as for conventional super alloy castings and in particular HIP processing often required due to the high levels of microporosity concomitant with rapid grain multiplication.

EXAMPLE 1

Cast turbine blades having a weight of 6 kg were successfully cast using this process. The blades were produced in a superalloy known as IN738LC and having a composition lying in the following range, expressed in % by weight.

| | |
|---|---|
| C | 0.09–0.13 |
| A1 | 3.20–3.70 |
| B | 0.007–0.012 |
| Co | 8.00–9.00 |
| Cr | 15.70–16.30 |
| Mo | 1.50–2.00 |
| Nb | 0.60–1.10 |
| Ta | 1.50–2.00 |
| Ti | 3.20–3.70 |
| W | 2.40–2.80 |
| Zr | 0.030–0.060 |
| Ni and usual incidentals | Balance |

A plurality of moulds were produced by the method described above. 4% by weight of the filler in the primary slurry coat of each mould was $CoAl_2O_4$. Each mould was pre-heated to 1100° C. and metal at a temperature of 1340° C. was poured into each mould. The resulting castings were free of unacceptable microporosity without HIP and had a grain distribution in both airfoil and root of 0.05 to 0.15 mm equiaxed. No columnar grain was observed at the metal mould interface.

EXAMPLE 2

Cast turbine blades having a weight of 22 kg were successfully cast using this process. The blades were produced in a superalloy known as IN792 MOD 5A and having a composition lying in the following range expressed in % by weight.

| | |
|---|---|
| C | 0.07–0.09 |
| A1 | 3.15–3.55 |
| B | 0.010–0.020 |
| Co | 8.50–9.50 |
| Cr | 12.20–12.80 |
| Mo | 1.70–2.10 |
| Ta | 3.85–4.25 |
| Ti | 3.75–4.15 |
| W | 3.85–4.25 |
| Zr | 0.015–0.025 |
| Ni and usual incidentals | Balance |

A plurality of moulds were again produced having 4% by weight of the filler of $CoAl_2O_4$ in the primary slurry coat. The moulds were also pre-heated to 1100° C. and metal at a temperature of 1340° C. was poured into each mould. The resulting castings were free of microporosity after HIP and had a grain size distribution in both airfoil and root of 0.04 to 0.16 mm equiaxed. No columnar grain was observed at the metal mould interface.

In each example, the mould temperature was predetermined based on the required quality during product development. Hence the metal temperature is fixed by the liquidus, the mould temperature is fixed by development on a job-by-job basis and this results in a relationship between metal and mould temperatures. In these examples the mould temperatures were 1100° C. The pouring temperatures of 1340° C. were based on a known liquidus temperature of around 1330° C. for each of these alloys.

In the specification all compositions are expressed in percentage by weight.

The features disclosed in the foregoing description expressed in their specific forms or in terms of a means for performing the disclosed function, or a method or process for attaining the disclosed result, as appropriate, may, separately or in any combination of such features, be utilised for realising the invention in diverse forms thereof.

I claim:

1. A method of making a fine equiaxed grained casting from molten metal comprising the steps of providing a mould having a surface which defines a mould cavity, said surface having on at least part thereof a compound comprising a nucleation agent, melting a metal, heating the mould, pouring the molten metal into the heated mould cavity at a predetermined pouring temperature lying in the range 0° C. to 15° C. above the liquidus temperature, the mould being heated so as to be at a predetermined temperature when the metal is poured in to the mould and solidifying the molten metal in the mould cavity.

2. A method according to claim 1 wherein the nucleation agent comprises cobalt aluminate or cobalt oxide.

3. A method according to claim 1 wherein there is a predetermined relationship between the mould temperature and the metal pouring temperature.

4. A method according to claim 3 wherein the relationship between mould and metal pouring temperature is established by the requirements of an individual job.

5. A method according to claim 1 wherein the mould temperature is determined for a particular casting, and is then fixed for that casting.

6. A method according to claim 1 wherein the predetermined mould temperature lies in the range 750° C. to 1250° C.

7. A method according to claim 1 wherein the predetermined pouring and mould temperatures are fixed for making at least one further casting.

8. A method according to claim 1 wherein said predetermined pouring temperature is predetermined in accordance with the article to be cast without performing a step of determining the melting temperature of the actual metal to be poured.

9. A method according to claim 1 wherein the mould surface is provided with a primary slurry coat having a filler and the nucleation agent comprises up to 25% to 50% of the filler of the primary slurry coat.

10. A method according to claim 1 wherein the minimum amount of nucleation agent is 1%.

11. A method according to claim 1 wherein the molten metal is solidified in the mould by permitting cooling of the mould to take place under ambient foundry conditions.

12. A method according to claim 1 wherein the mould is made using a pattern, and the pattern is produced from an expendable material.

13. A method according to claim 1 wherein the mould is made using a pattern and the pattern contains at least one ceramic core which has a nucleation agent selected from the group comprising nucleation agent included in the core mix, nucleation agent added to the surface of the mould cavity, nucleation agent added to the surface of the core, and nucleation agent added to the surface of the mould cavity and core.

14. A method according to claim 1 wherein the mould is made on at least one pattern, the or each pattern being assembled onto a support.

15. A method according to claim 1 wherein the casting is hot isostatic pressed.

16. A method according to claim 1 wherein disintegration of dendrite structure occurs at a point when the remaining liquid is cooled sufficiently to prevent remelting of the dendrite fragments or to prevent significant grain growth after solidification and the remaining liquid is not over cooled.

17. A method according to claim 1 wherein nucleation of ultra fine grains occurs by dendrite fragmentation caused by recalescence and remelting.

* * * * *